United States Patent [19]

Hieda et al.

[11] 4,182,580

[45] Jan. 8, 1980

[54] UNDERDRAINAGE PIPE

[75] Inventors: Shozo Hieda, Otake; Yoshio Uehara, Kashiwa; Minoru Inaba, Chiba, all of Japan

[73] Assignee: Mitsui Petrochemical Industries, Ltd., Tokyo, Japan

[21] Appl. No.: 887,746

[22] Filed: Mar. 17, 1978

[30] Foreign Application Priority Data

Mar. 18, 1977 [JP] Japan ..... 52-32097[U]

[51] Int. Cl.[2] ..... E02B 13/00; F16L 11/11

[52] U.S. Cl. ..... 405/43; 405/49; 138/173

[58] Field of Search ..... 61/10, 11, 12, 13; 138/172, 173, 174

[56] References Cited

U.S. PATENT DOCUMENTS

| | | | |
|---|---|---|---|
| 3,747,352 | 7/1973 | Maroschak | 61/10 |
| 3,861,152 | 1/1975 | Maroschak | 61/11 |
| 3,976,578 | 8/1976 | Beane | 61/11 |
| 4,061,368 | 12/1977 | Auriemma | 61/10 |

FOREIGN PATENT DOCUMENTS

| | | | |
|---|---|---|---|
| 1458179 | 10/1966 | Fed. Rep. of Germany | 61/11 |
| 222259 | 12/1967 | Sweden | 61/11 |

*Primary Examiner*—Mervin Stein
*Assistant Examiner*—Alexander Grosz
*Attorney, Agent, or Firm*—Cooper, Dunham, Clark, Griffin & Moran

[57] ABSTRACT

An underdrainage pipe comprises a liquid-collecting pipe, protrusions on the liquid-collecting pipe, a filter layer around the liquid-collecting pipe and a liquid-conducting way, and the protrusions having at least one recess for each and the bottom portion of the recess not reaching the surface of the liquid-collecting pipe.

4 Claims, 11 Drawing Figures

UNDERDRAINAGE PIPE

BACKGROUND OF THE INVENTION

1. Field of the Invention

This invention relates to an underdrainage pipe capable of withstanding a relatively large pressure and weight.

2. Description of the Prior Art

A conventional pipe having a longitudinal cross section of a wave form is structurally stronger than a pipe having a flat surface wall, but is often broken or bent by buckling when subjected to an external pressure or weight.

SUMMARY OF THE INVENTION

It is an object of the present invention to provide an underdrainage pipe of a high mechanical strength capable of withstanding a high external pressure and weight.

It is another object of the present invention to provide an underdrainage pipe of a high mechanical strength and free from clogging caused by soil and sand.

According to the present invention, there is provided an underdrainage pipe which comprises (1) a liquid-collecting pipe; (2) protrusions disposed at intervals on the outer surface of the liquid-collecting pipe, each protrusion being provided with at least one recess of which the bottom portion does not reach the outer surface of the liquid-collecting pipe, and the recesses on the adjacent protrusions being staggered that is not overlapping in the longitudinal direction; (3) a filter layer disposed around the liquid-collecting pipe and contracting the top portions of the protrusions and capable of substantially preventing entry of solids into the liquid collecting pipe; and (4) a liquid-collecting way composed of a space communicating both in the longitudinal direction and in the peripheral direction as to the liquid-collecting pipe and defined by the protrusions, the outer surface of the liquid-collecting pipe and the inner surface of the filter layer.

DESCRIPTION OF THE PREFERRED EMBODIMENTS

The present invention will be explained in detail in the following.

Figure 1:
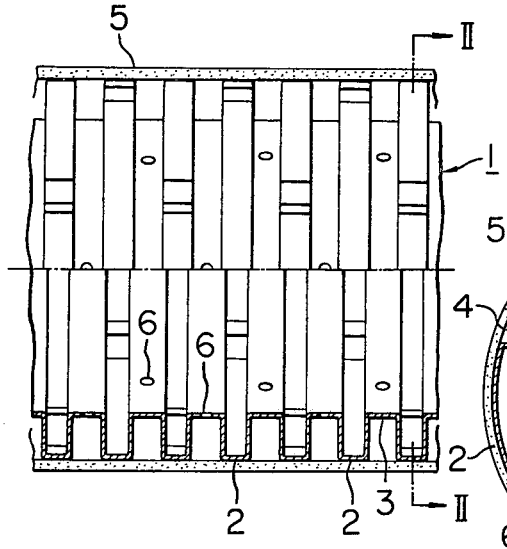
FIG. 1 shows an embodiment of the present invention, in which the upper half is a side view while the lower half is a cross section.
Figure 2:
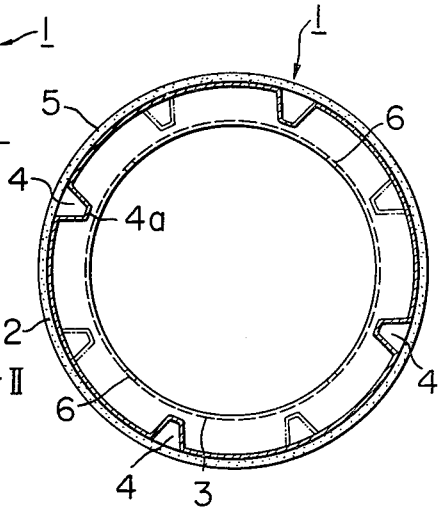
FIG. 2 shows a cross sectional view along the II—II line of FIG. 1.

In FIG. 1 and FIG. 2, a pipe 1 comprises a filter layer 5, protrusions 2, and a bottom wall (an outer surface wall of a liquid-collecting pipe) 3, and the protrusions are peripherally disposed. The cross section of the protrusion 2 is rectangular in FIG. 1, but may be circular, oval or other shape. The cross sectional shape can be optionally selected depending upon the desired method for manufacturing and strength of the pipe.

Figure 3:
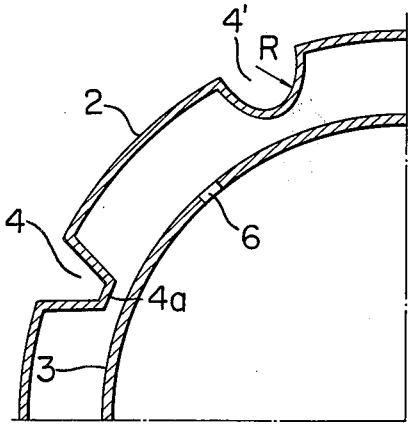
FIG. 3 shows an enlarged cross sectional view of the recess portions.
Figure 4:
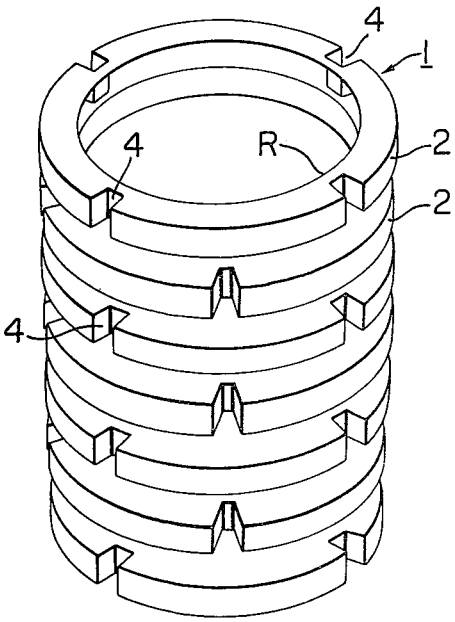
FIG. 4 shows an oblique view of the pipe.

FIG. 2 and FIG. 3, several recesses are formed in each peripheral type protrusion 2. The bottom portion 4*a* of the recess does not reach the bottom wall 3 and therefore a raised portion R is formed and this raised portion serves to reinforce the strength of the pipe. In FIG. 2, the cross section of the recess is a trapezoid, that is, both side walls of the recess converge towards the center of the pipe 1 when the walls are extended.

External pressure is dispersed from the recess 4 portion and thereby, concentration of stress can be avoided and the pipe is not destroyed. This is also the case for an internal pressure. The shape of recess 4 may be circular as designated by 4' in FIG. 3, rectangular or others. Recesses on the adjacent protrusions should not overlap in the longitudinal direction. Otherwise the overlapped portion, that is, a line connecting such recesses on the same longitudinal direction, is a weak portion against bending and pressure.

To avoid such disadvantages, recesses may be positioned zigzag, or distribution of recesses may be at random unless it is unbalanced against pressure.

Figure 5:
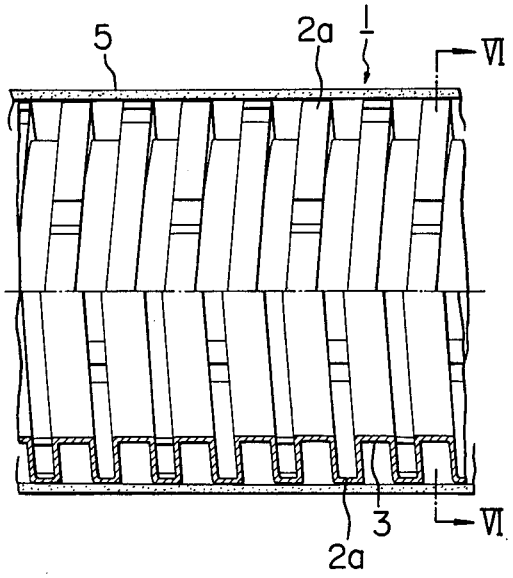
FIG. 5 shows another embodiment of the present invention, in which the upper half is a side view while the lower half is a cross sectional view.
Figure 6:
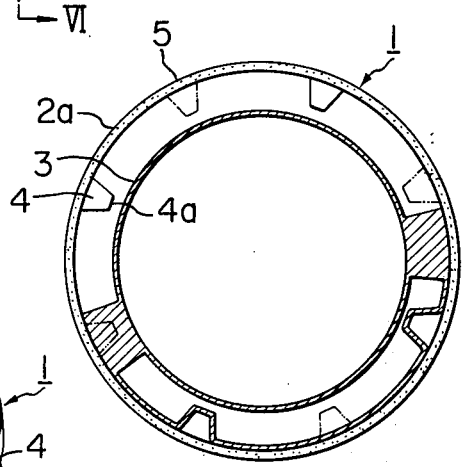
FIG. 6 is a cross sectional view along a line VI—VI of FIG. 5.
Figure 7:
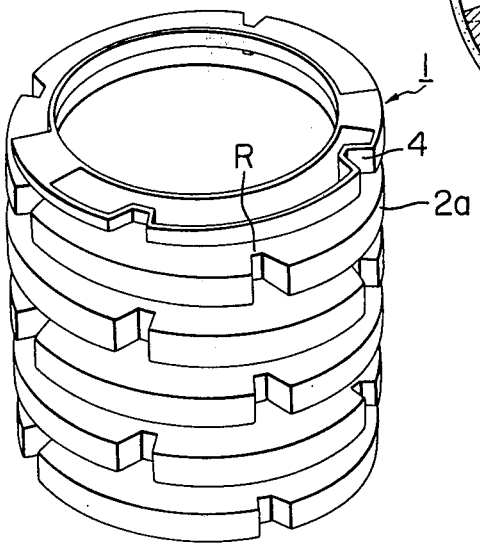
FIG. 7 is an oblique view of the embodiment in FIG. 5.

In FIG. 5 through FIG. 7, protrusions 2*a* are disposed spirally and the bottom portion 4*a* of the resess 4 does not reach the bottom wall 3, but a raised portion R is formed.

Figure 8:
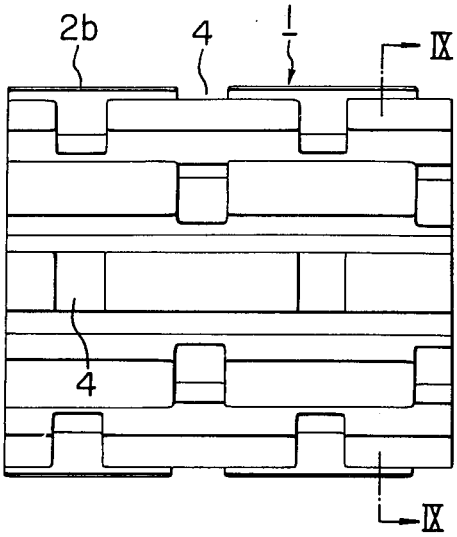
FIG. 8 is a further embodiment of the present invention.
Figure 9:
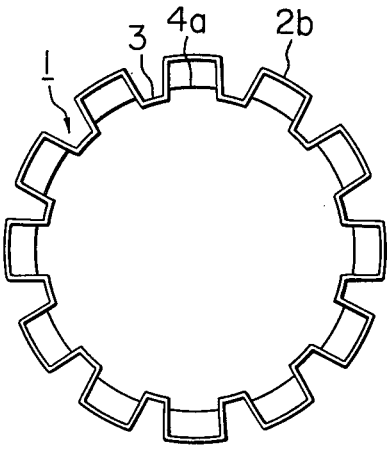
FIG. 9 is a cross sectional view along a line IX—IX of FIG. 8.
Figure 10:
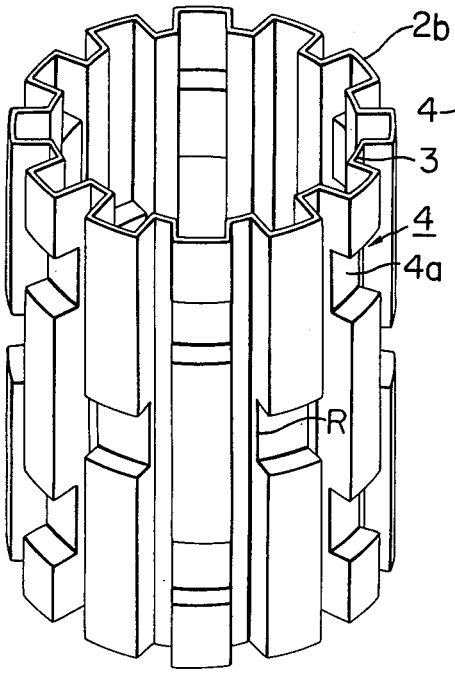
FIG. 10 is an oblique view of the embodiment.

FIG. 8 through FIG. 10, protrusions 2*b* are formed in the longitudinal direction. The recess 4 in the protrusion 2*b* descends only up to the bottom porton 4*a* and does not reach the bottom wall 3 and a raised portion R is retained. It is clear in this embodiment that recesses in adjacent protrusions can not overlap in the longitudinal direction.

Figure 11:
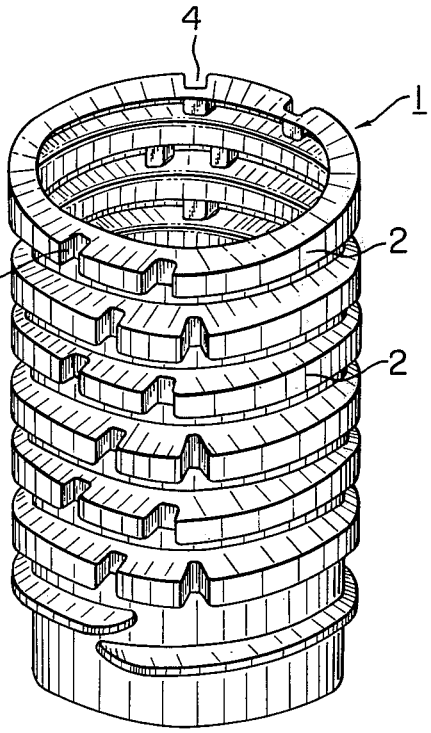
FIG. 11 is an oblique view of still another embodiment of the present invention.

FIG. 11 shows another embodiment of the present invention which has protrusions 2 disposed in a peripheral direction and having recesses 4 with a raised portion at the bottom portion, and the recesses 4 are not uniformly distributed along the periphery, but are present at two particular portions. This type of recess distribution is convenient for manufacturing the pipe by plastic molding, i.e. for removing separated molds after molding. In other wordds, a liquid-collecting pipe is firstly shaped and then put between metal molds having recesses and protrusions on the inside surface while the shaped pipe is still hot and thereby a recess and protrusion pattern is formed on the surface of the pipe. In the above procedure, a two-separable metal mold is usually used and it is preferable to position the recesses at two portions to which directions from the axis of the pipe the two metal molds are separated for easy removal. In a similar way, if a three-separable or more separable mold is used, the recesses are produced at the portions on the periphery to which direction from the axis of the pipe the separated molds are removed.

Small through-holes may be provided on the bottom wall in embodiments of the present invention as mentioned above. If desired, the small through-holes may be formed at the protrusion.

In FIG. 1 through FIG. 11, in general, reference numeral 1 denotes a liquid-collecting pipe with protrusions, reference numerals 2, 2*a*, 2*b* denote protrusions, and reference numerals 3, 4, 5 and 6 denote a bottom wall, a recess, a filter layer and a through hole, respectively.

When the underdrainage pipe is buried in the ground, water passes through the filter layer and comes to the liquid-conducting way and then flows into the liquid-collecting pipe through a joint portion of the pipes where the liquid-conducting way communicates with the inside of the liquid-collecting pipe and, if there are the small through-holes on the bottom wall, water in the liquid-conducting way flows into the liquid-collecting pipe through them.

The filter layer 5 which captures solid particles such as soil and sands flowing together with underground water and surface water and allows substantially liquid only to pass through, used in the present invention may be a synthetic resin net, a net made of synthetic or natural fibers, woven cloth, non-woven cloth, a sheet-like material having through-holes produced by a mechanical means, a foamed sheet, or a foamed sheet having small through-holes produced by rupturing foams during the foam shaping, or combination thereof. Diameter of the small hole is usually 0.1–5 mm., preferred with 1–2 mm. when produced by rupturing foams of a foamed sheet.

The filter layer 5 may be disposed around the liquid-collecting pipe having protrusions by simply covering the liquid-collecting pipe or fixed to the top portions of the protrusions. Where both the protrusions and the filter layer are composed of synthetic resins, they can be thermally adhered with each other so that the production, construction and maintenance are easy and sure.

Where the liquid-collecting pipe and the filter layer 5 are made of synthetic resins, they are light, durable and corrosion-resistant. In particular, where they are made of polyolefin, clogging is negligible.

The underdrainage pipes according to the present invention can be easily used to construct a sure underdrainage system without using conventional filter materials such as chaffs, rubbles, and gravels, but if desired, such conventional filter materials may be used together with the underdrainage pipes of the present invention.

The underdrainage pipe of the present invention may be buried in the ground for facilitating drainage at agricultural fields, lands for housing, damp grounds, playing fields, and tennis courts. Playing fields and tennis courts can be used in a short time after rain.

The underdrainage pipe of the present invention can withstand various pressure and weight because the recess has a raised portion. Therefore, a thin pipe wall can be employed and manufacturing such pipe is easy and further the manufacturing cost is very low.

What we claim is:

1. An underdrainage pipe which comprises:

(1) a liquid collecting pipe;

(2) protrusions disposed at an interval on the outer surface of the liquid collecting pipe, each protrusion being provided with at least one recess of which the bottom portion does not reach the outer surface of the liquid collecting pipe, the recesses on the adjacent protrusions being staggered in the longitudinal direction;

(3) a plurality of through-holes on the outer surface of the liquid collecting pipe and between the protrusions;

(4) a filter layer capable of substantially preventing entry of solid into the liquid collecting pipe, the filter layer being disposed around the liquid collecting pipe, and contacting the top portions of the protrusions; and (5) a liquid conducting way composed of a space communicating both in the longitudinal direction and in the peripheral direction of the liquid collecting pipe and defined by the protrusions, the outer surface of the liquid collecting pipe and the inner surface of the filter layer.

2. An underdrainage pipe according to claim 1 in which the protrusions are peripherally disposed at an interval in the longitudinal direction.

3. An underdrainage pipe according to claim 1 in which the protrusions are disposed in a spiral form.

4. An underdrainage pipe according to claim 1 in which the protrusions are longitudinally disposed at an interval in the peripheral direction.

* * * * *